US010465966B2

(12) United States Patent
Bertolini et al.

(10) Patent No.: US 10,465,966 B2
(45) Date of Patent: Nov. 5, 2019

(54) ICE MAKING SYSTEM AND AIR FLOW CIRCULATION FOR SLIMLINE ICE COMPARTMENT

(71) Applicants: BSH Home Appliances Corporation, Irvine, CA (US); BSH Hausgeräte GmbH, Munich (DE)

(72) Inventors: Nilton Bertolini, Knoxville, TN (US); Marco Marques, Knoxville, TN (US); Jorge Carlos Montalvo Sanchez, Knoxville, TN (US); Marco Rotonda, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 161 days.

(21) Appl. No.: 15/643,618

(22) Filed: Jul. 7, 2017

(65) Prior Publication Data

US 2019/0011166 A1 Jan. 10, 2019

(51) Int. Cl.

| | |
|---|---|
| ***F25C 1/24*** | (2018.01) |
| ***F25C 5/20*** | (2018.01) |
| ***F25D 17/06*** | (2006.01) |
| *F25D 23/02* | (2006.01) |

(52) U.S. Cl.

CPC ..... *F25C 1/24* (2013.01); *F25C 5/22* (2018.01); *F25D 17/065* (2013.01); *F25C 2400/10* (2013.01); *F25C 2700/12* (2013.01); *F25D 23/02* (2013.01); *F25D 2317/061* (2013.01); *F25D 2317/063* (2013.01); *F25D 2317/0665* (2013.01); *F25D 2317/0671* (2013.01); *F25D 2700/10* (2013.01); *F25D 2700/122* (2013.01)

(58) Field of Classification Search

CPC ..... F25C 1/24; F25C 5/22; F25C 2400/10

See application file for complete search history.

(56) References Cited

U.S. PATENT DOCUMENTS

| | | | | |
|---|---|---|---|---|
| 7,152,424 | B2 * | 12/2006 | Shoukyuu | F25C 1/24 62/351 |
| 7,406,838 | B2 * | 8/2008 | Wang | F25C 1/08 62/344 |
| 8,316,661 | B2 * | 11/2012 | Choi | F25C 1/24 62/337 |

(Continued)

*Primary Examiner* — Filip Zec

(74) *Attorney, Agent, or Firm* — Michael E. Tschupp; Andre Pallapies; Brandon G. Braun

(57) ABSTRACT

A refrigerator including a refrigerator compartment; a freezer compartment; an ice compartment disposed in the refrigerator compartment; an ice maker assembly disposed in the ice compartment, the ice maker assembly including an ice maker tray/evaporator having an evaporator cooling tube which is in direct contact with the ice maker tray portion; an ice bucket for storing ice disposed in the ice compartment; and an air handler/auger motor assembly disposed at a rear portion of the ice compartment behind the ice bucket. The air handler/auger motor assembly includes an air passage having a fan disposed therein. An inlet of the fan communicates with an airflow passage under the ice maker tray/evaporator, such that the fan creates a suction and draws cool air from the ice maker tray/evaporator and discharges the cool air through the air passage and to the ice bucket to prevent any ice in the ice bucket from melting.

20 Claims, 14 Drawing Sheets

(56) References Cited

U.S. PATENT DOCUMENTS

| | | | | |
|---|---|---|---|---|
| 8,844,310 | B2 * | 9/2014 | Chase | F25C 5/187 62/344 |
| 8,950,197 | B2 * | 2/2015 | Bortoletto | F25C 1/20 62/348 |
| 9,080,799 | B2 | 7/2015 | Hong et al. | |
| 9,448,003 | B2 | 9/2016 | Shin et al. | |
| 9,482,458 | B2 | 11/2016 | Jeong et al. | |
| 9,506,680 | B2 | 11/2016 | Jeong et al. | |
| 2008/0295539 | A1 * | 12/2008 | An | F25D 17/065 62/407 |
| 2009/0193824 | A1 | 8/2009 | Heger et al. | |
| 2010/0218519 | A1 * | 9/2010 | Hall | F25B 41/062 62/73 |
| 2010/0218542 | A1 * | 9/2010 | McCollough | F25C 5/22 62/345 |
| 2010/0257889 | A1 * | 10/2010 | Lee | F25C 1/24 62/344 |
| 2016/0370065 | A1 | 12/2016 | Yang | |

* cited by examiner

ICE MAKING SYSTEM AND AIR FLOW CIRCULATION FOR SLIMLINE ICE COMPARTMENT

FIELD OF THE INVENTION

The present disclosure relates generally to a refrigerator appliance and to an ice making system disposed in a dedicated ice compartment of the refrigerator appliance. More particularly, the present disclosure relates to a compact ice making system and air flow circulation for use in a slimline ice compartment having a side-by-side ice maker and ice bucket.

BACKGROUND OF THE INVENTION

In general, refrigerator appliances, such as for household use, typically have a bulky ice compartment for making and storing ice located within the fresh food compartment. The ice compartment assembly has an over-under arrangement where the ice maker is positioned on top and the ice bucket is located underneath the ice maker within the ice compartment.

SUMMARY OF THE INVENTION

On the other hand, making the ice compartment and bucket larger especially in the vertical height direction takes up too much volume in the fresh food compartment, thereby making it less desirable to customers/users. In this regard, customers/users want to maximize the volume of the fresh food compartment for the storage of fresh food items. Making the ice compartment taller also limits a design to be used only on taller doors (for example, it would not be useable in models with more than 1 drawer and two doors), and/or require the ice and water dispenser to be positioned at a lower position which is not ergonomically optimum for customers/users.

An apparatus consistent with the present disclosure is directed to a self-contained, dedicated compartment for producing and storing ice, without using cold air that is produced outside of the ice compartment and then ducted to and from the ice compartment. This in turn minimizes any ice contamination by air that has moved from another compartment and makes the ice compartment less dependent on the freezer compartment states or temperatures.

An apparatus consistent with the present disclosure is directed to a slimline ice compartment which takes up less volume in the fresh food compartment and results in faster ice production.

An apparatus consistent with the present disclosure results in a significant reduction of the internal volume that the ice compartment takes up inside the fresh food compartment, as it combines an ice tray and an evaporator into a single piece with the bottom of the ice maker (a metallic tray portion) also acting as an evaporator for the ice compartment. This in turn eliminates the need for an additional evaporator to cool the air inside the insulated ice compartment.

An apparatus consistent with the present disclosure results in a much higher ice production, as the evaporator cooling tube is in direct contact with the ice maker tray portion of the ice maker tray/evaporator, and this in turn reduces the time to fill the ice bucket. In particular, the ice maker tray/evaporator of the present disclosure freezes the water in the mold cavities very fast, since the ice maker tray portion temperature runs as cold as the refrigerant is evaporated.

An apparatus consistent with the present disclosure results in a configuration where the air flow is pulled or sucked under the ice maker tray portion of the ice maker assembly thereby to maximize the heat transfer. Moreover, having the air return closer to a front portion of the ice bucket (warmest area) allows the evaporator fins of the ice maker tray/evaporator to be designed with optimum spacing to prevent ice accumulation that could choke the air flow under the ice maker tray/evaporator and cause temperatures inside the ice compartment to rise.

An apparatus consistent with the present disclosure is directed to a slimline ice compartment having a side-by-side ice maker and ice bucket.

According to one aspect, the present disclosure provides a refrigerator including a refrigerator compartment; a freezer compartment; an ice compartment disposed in the refrigerator compartment; an ice maker assembly disposed in the ice compartment, the ice maker assembly including an ice maker tray/evaporator having an evaporator cooling tube which is in direct contact with the ice maker tray portion; an ice bucket for storing ice disposed in the ice compartment; and an air handler/auger motor assembly disposed at a rear portion of the ice compartment behind the ice bucket. The air handler/auger motor assembly includes an air passage having a fan disposed therein. An inlet of the fan communicates with an airflow passage under the ice maker tray/evaporator, such that the fan creates a suction and draws cool air from the ice maker tray/evaporator and discharges the cool air through the air passage and to the ice bucket to prevent any ice in the ice bucket from melting.

According to another aspect, the ice maker assembly and the ice bucket are arranged side-by-side in a horizontal direction within the ice compartment.

According to another aspect, no portion of the ice bucket is located below the ice maker assembly when the ice maker assembly is projected downward in a vertical height direction.

According to another aspect, the ice compartment is disposed in an upper corner of the refrigerator compartment.

According to another aspect, the refrigerator is a French door-bottom mount configuration having the refrigerator compartment on top and the freezer compartment below the refrigerator compartment.

According to another aspect, the ice compartment is disposed in an upper left hand corner of the refrigerator compartment.

According to another aspect, the ice bucket is removably mounted in the ice compartment.

According to another aspect, the ice compartment has a thin dimension in a vertical height direction H of approximately 5.6 inches±2.0 inches, and wherein the ice compartment has a horizontal width W of approximately 10.4 inches±2.0 inches.

According to another aspect, the ice bucket has a front cover, and the front cover has an opening in a bottom portion for discharging pieces of ice.

According to another aspect, the refrigerator compartment includes a door, and further comprising an ice chute for an ice dispenser and being disposed in the door, the ice chute being configured to communicate with the opening in the front cover via an ice chute extension.

According to another aspect, the evaporator cooling tube is formed of at least one of copper or a copper alloy.

According to another aspect, the ice maker tray portion is formed of at least one of aluminum or an aluminum alloy.

According to another aspect, a bottom portion of the ice maker tray/evaporator includes evaporator fins which extend downward substantially vertically.

According to another aspect, the air passage is located at an upper portion of the air handler/auger motor assembly.

According to another aspect, the air passage makes a substantially 90 degree turn and widens prior to emptying into the ice bucket.

According to another aspect, the present disclosure provides a refrigerator including: a fresh food compartment; a freezer compartment; an ice compartment disposed in the fresh food compartment; an ice maker assembly disposed in the ice compartment, the ice maker assembly including an ice maker tray/evaporator having an evaporator cooling tube which is in direct contact with an ice maker tray portion; an ice bucket for storing ice, the ice bucket being disposed in the ice compartment; and an air guide disposed at a rear portion of the ice compartment adjacent to the ice bucket; wherein the air guide comprises an air passage having a fan disposed therein, wherein an inlet of the fan communicates with an airflow passage under the ice maker tray/evaporator, such that the fan creates a suction in the airflow passage under the ice maker tray/evaporator and discharges the cool air through the air passage of the air guide and to the ice bucket.

According to another aspect, the air guide is disposed above a rear portion of the ice bucket.

According to another aspect, the air passage of the air guide makes a substantially 90 degree turn and widens prior to opening above the ice bucket.

According to another aspect, the air guide comprises a plurality of mounting hooks on a top surface thereof.

According to another aspect, the ice bucket comprises an inner side wall formed with a plurality of through-holes which allow air that has cooled the ice to exit the ice bucket and enter at a front end portion of the airflow passage under the ice maker tray/evaporator.

According to another aspect, a bottom portion of the ice maker tray/evaporator includes evaporator fins which extend downward substantially vertically into the airflow passage under the ice maker tray/evaporator.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 7B:
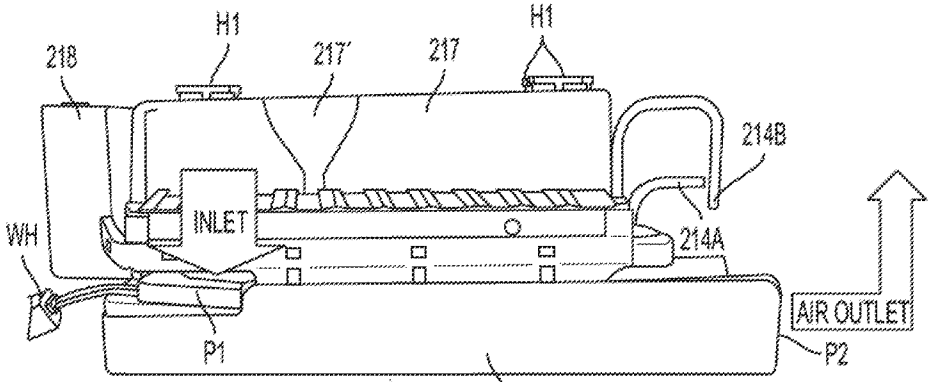
Figure 7C:
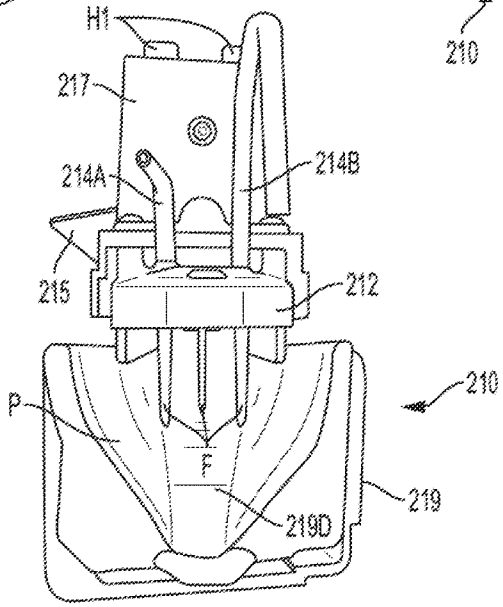
Figure 7A:
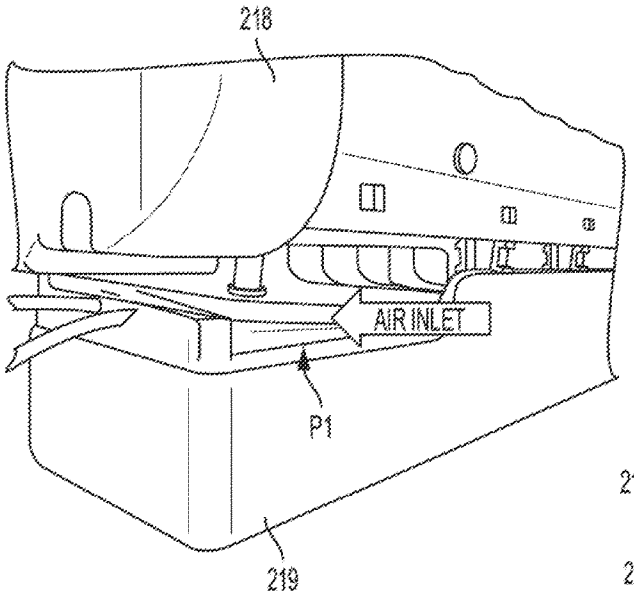
Figure 8B:
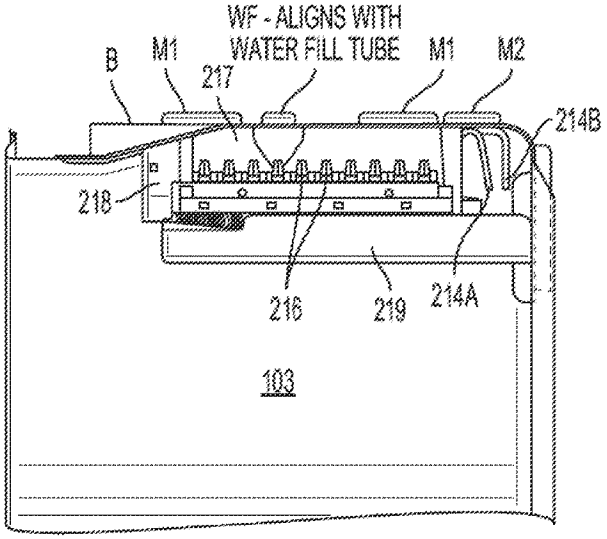
Figure 8C:
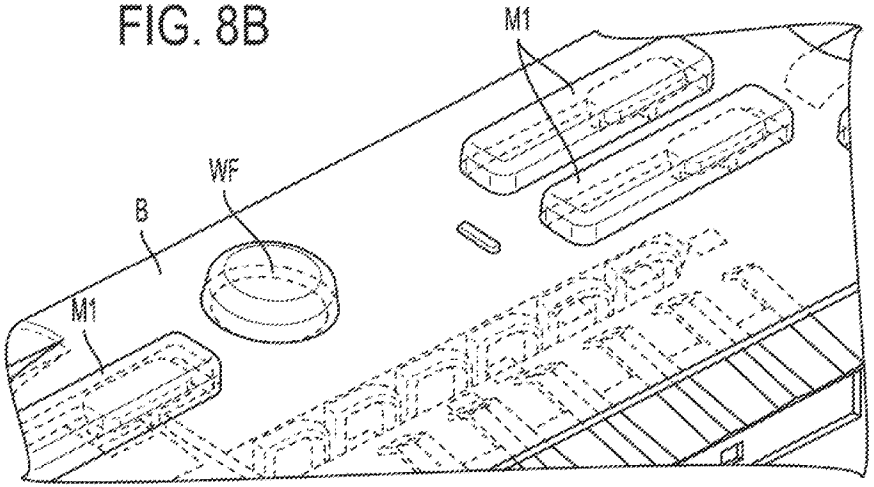
Figure 8A:
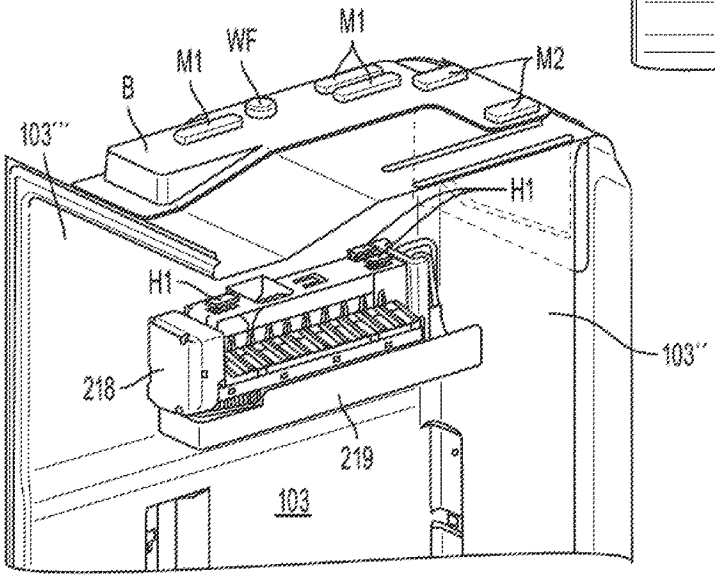
Figure 9:
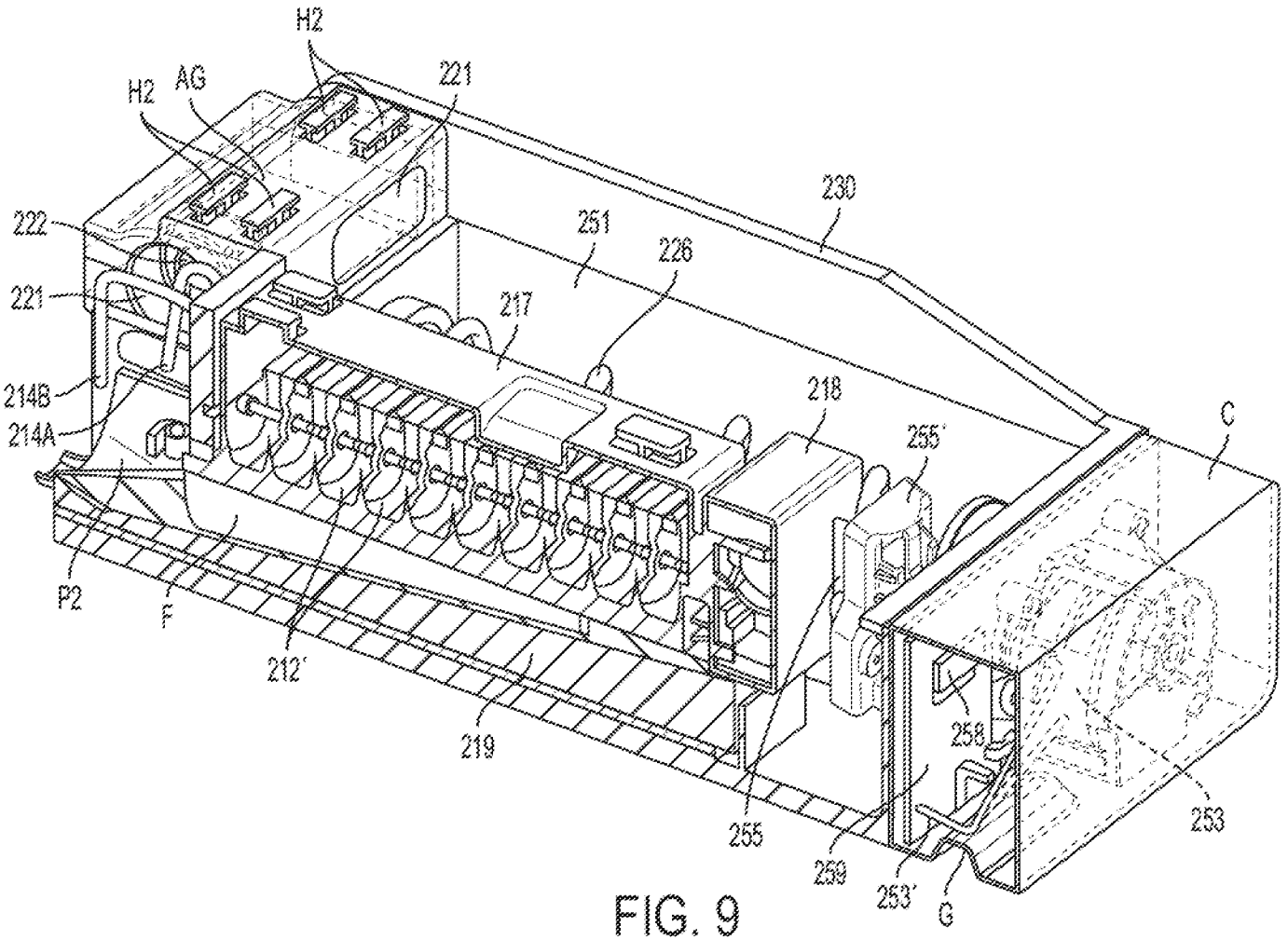
Figure 10:
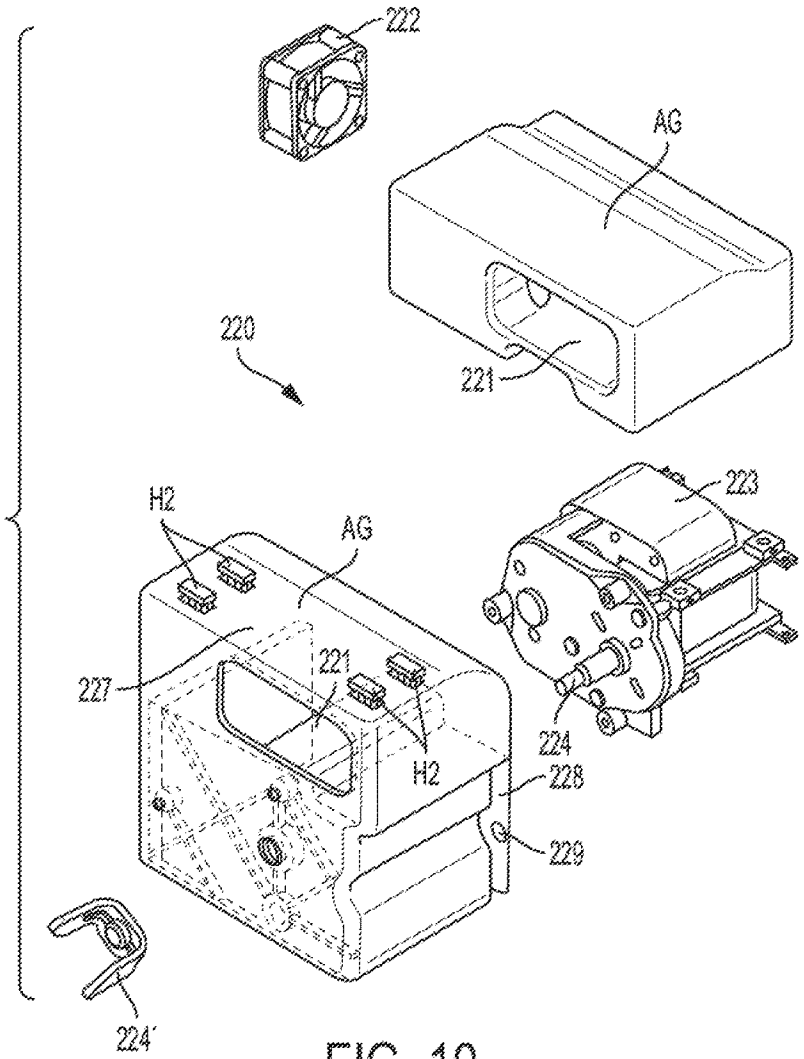
Figure 11:
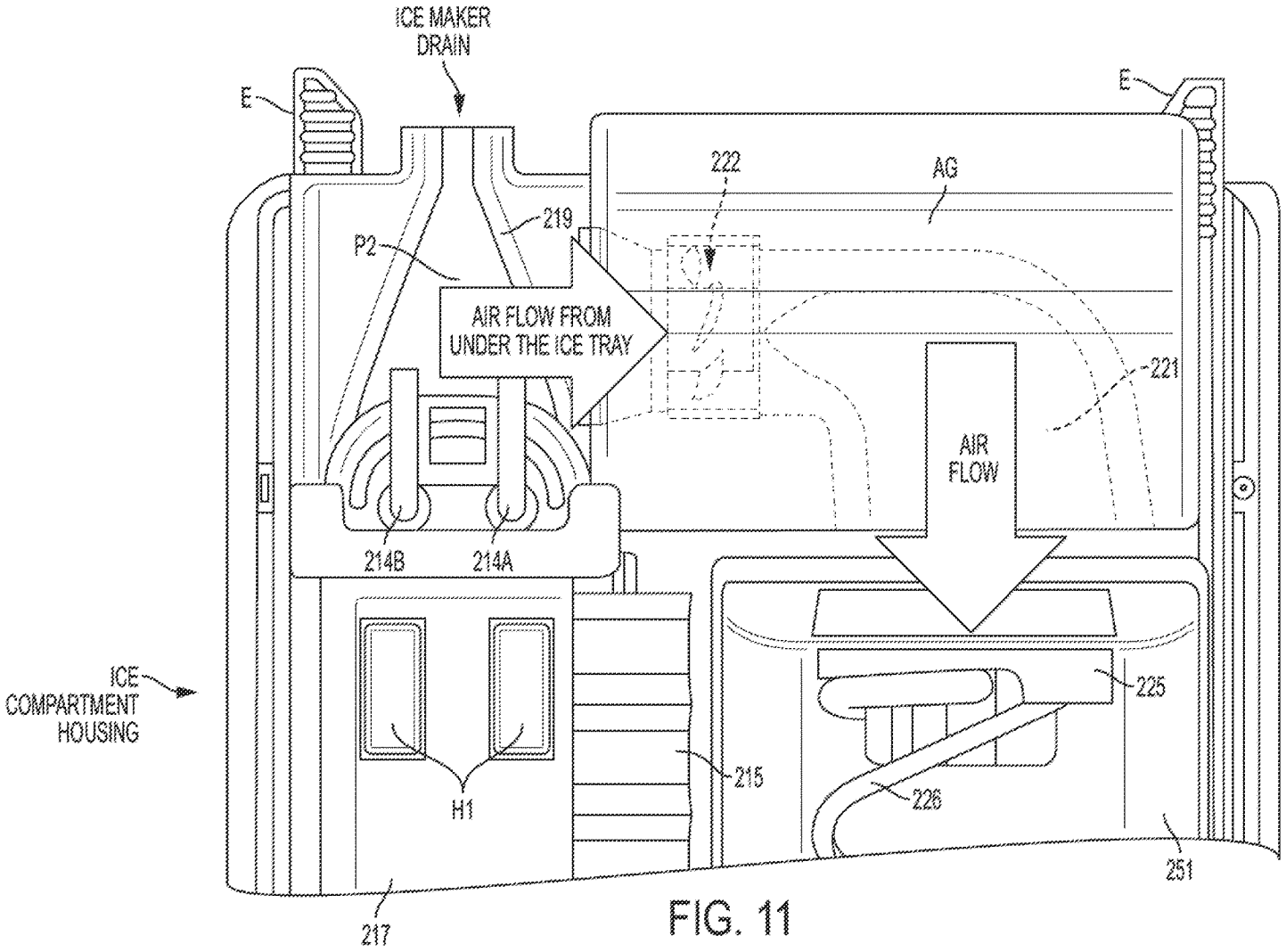
Figure 12A:
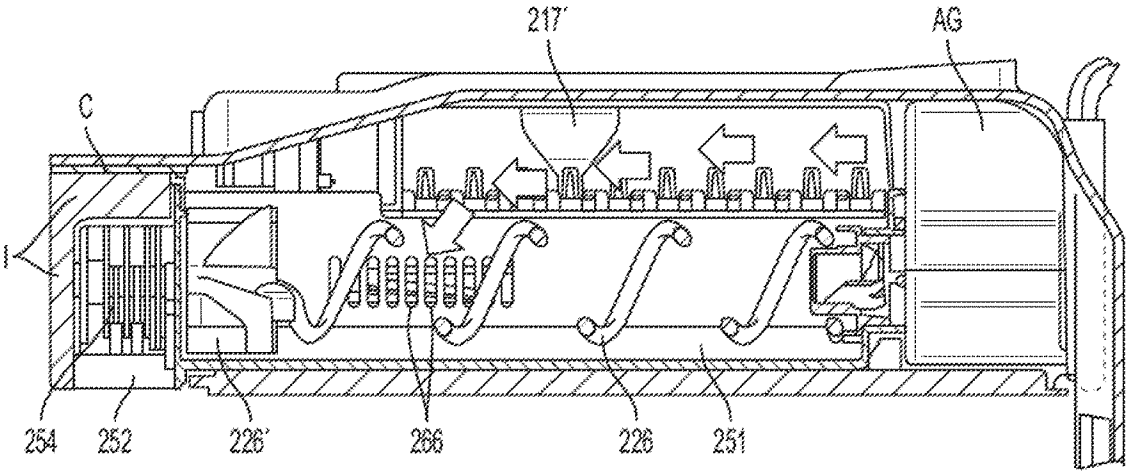
Figure 12B:
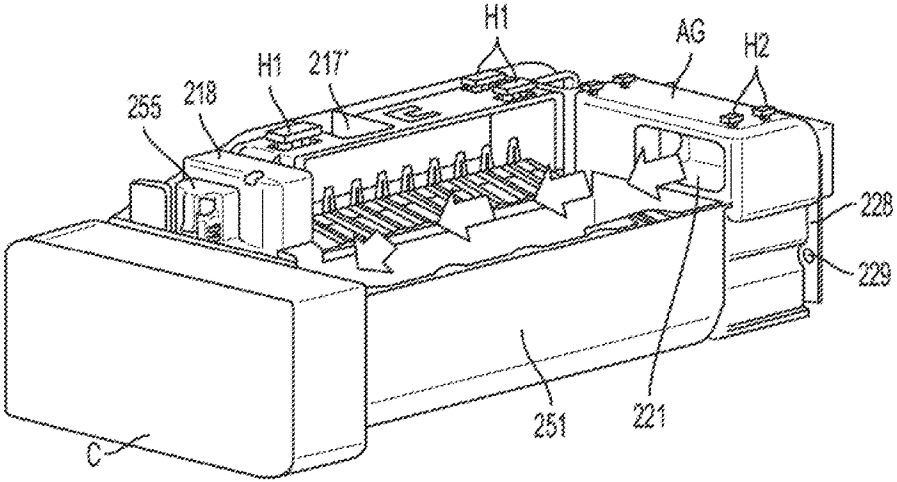
Figure 13:
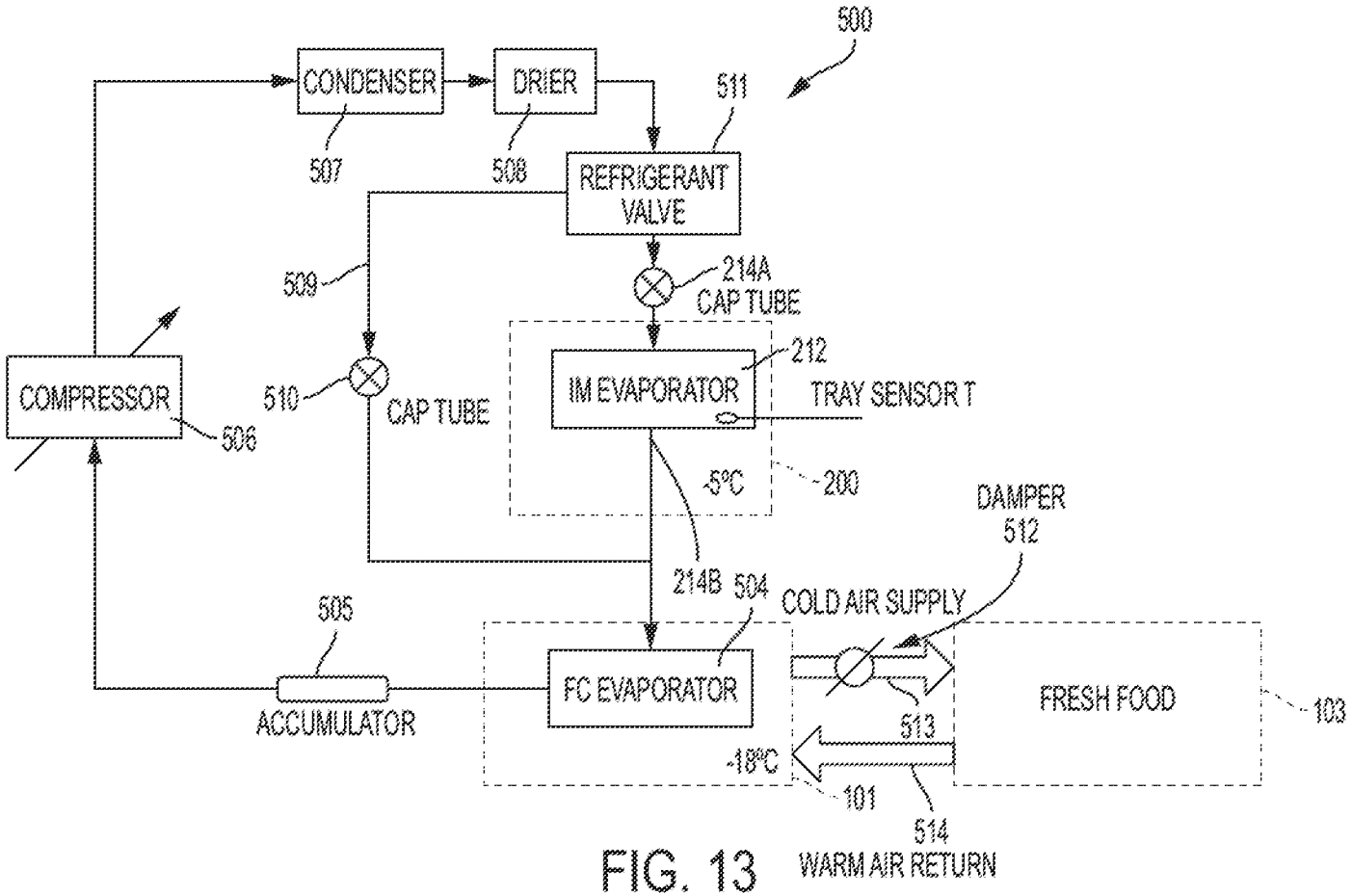

FIGS. 7A, 7B, and 7C are various perspective views of the ice maker assembly showing the air flow and the evaporator fins according to an exemplary embodiment consistent with present disclosure;

FIGS. 8A, 8B, and 8C are various views of the ice maker assembly being mounted to the foamed-in bracket according to an exemplary embodiment consistent with present disclosure;

FIG. 9 is a perspective cutaway view showing the complete ice maker/ice bucket/ice compartment assembly from the side facing the inner side wall of the refrigerator compartment according to an exemplary embodiment consistent with present disclosure;

FIG. 10 shows an exploded perspective view of the air handler/auger motor assembly according to an exemplary embodiment consistent with present disclosure;

FIG. 11 shows a top detailed view of the rear portion of the complete ice maker/ice bucket/ice compartment assembly to show the air flow circulation according to an exemplary embodiment consistent with present disclosure;

FIGS. 12A and 12B show the air flow circulation inside the ice compartment according to an exemplary embodiment consistent with present disclosure; and FIG. 13 shows a freezer compartment/icemaker refrigerant circuit according to an exemplary embodiment consistent with present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rearward, upper, lower, upward, downward, and the like used herein are for orientation purposes with respect to the drawings when describing the exemplary embodiments and should not limit the present invention. Also, terms such as substantially, approximately, and about are intended to allow for variances to account for manufacturing tolerances, measurement tolerances, or variations from ideal values that would be accepted by those skilled in the art.

Figure 1:
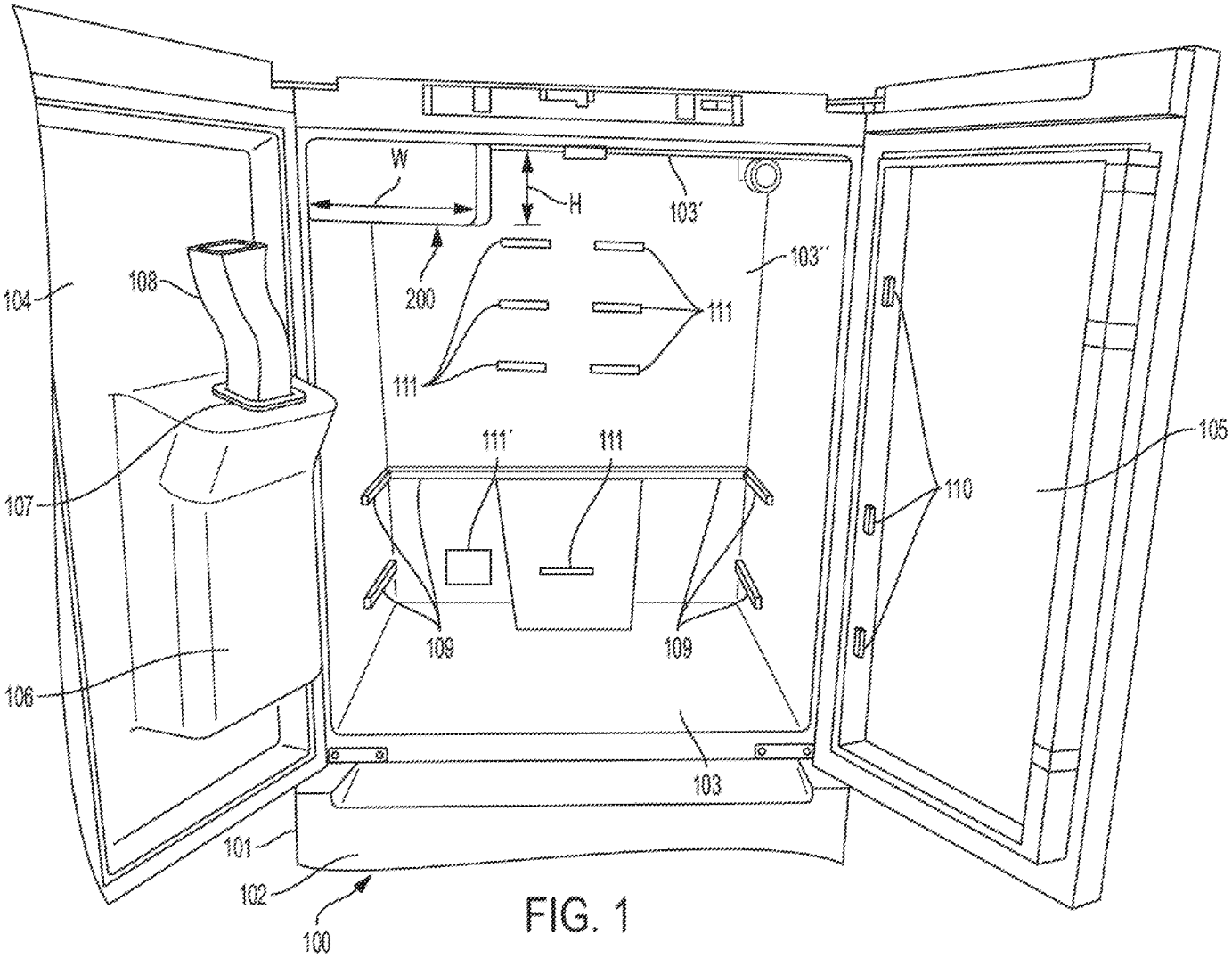
FIG. 1 illustrates a fragmentary front perspective view of a French door-bottom mount style refrigerator with the doors open to reveal the slimline ice compartment according to an exemplary embodiment consistent with present disclosure.

FIG. 1 illustrates a front perspective view of a French door-bottom mount style refrigerator 100 with the doors open to reveal the slimline ice compartment 200 according to an exemplary embodiment consistent with present disclosure. More specifically, the refrigerator 100 includes an insulated body having a freezer compartment 101 (bottom mount style) covered by a freezer door 102, and a fresh food compartment 103 (also referred to as a refrigerator compartment 103) located above the freezer compartment 101 and having two refrigerator doors 104 and 105 (French door style) which are shown in the open position. While two refrigerator doors are shown, clearly a single refrigerator door could be used, or more than two doors such as with door-in-door configurations. The shelves and food racks have been removed from inside the fresh food compartment 103 and from the inside of the refrigerator doors 104 and 105 for ease of understanding. The left door 104 includes a projecting housing portion 106 on the inner liner and which accommodates a water and ice dispenser assembly (not visible) accessible by the user on the front side of the door 104. An opening 107 of a dispenser ice chute (not visible) for guiding ice to the dispenser is arranged at the top of the projecting housing portion 106. As will be described in more detail below, the dispenser ice chute communicates with an opening in a front cover of the ice bucket via an ice chute extension 108. The inner liner side walls of the fresh food compartment 103 include protrusions 109 for supporting shelving (not shown). The right door 105 includes projections 110 for supporting door racks (not shown). Also shown in FIG. 1 are air openings 111 for cold air to enter into the fresh food compartment 103 (see the smaller elongated slots) and an opening 111' for return air to exit the fresh food compartment 103 (see the larger square opening on the bottom left). The freezer compartment is typically set at −18° C. or colder, and the fresh food compartment is typically set in a range of 1° C. to 4° C.

The slimline ice compartment 200 is disposed in an upper left hand corner of the fresh food compartment 103. The slimline ice compartment 200 can be located at other positions within the fresh food compartment 103, in one of the refrigerator doors 104, 105, or even in the freezer compartment 101 if desired, especially in a side-by-side freezer/refrigerator configuration. The slimline ice compartment 200 has a thin dimension in a vertical height direction H of approximately 5.6 inches±2.0 inches and has a horizontal width W of approximately 10.4 inches±2.0 inches.

Figure 2:
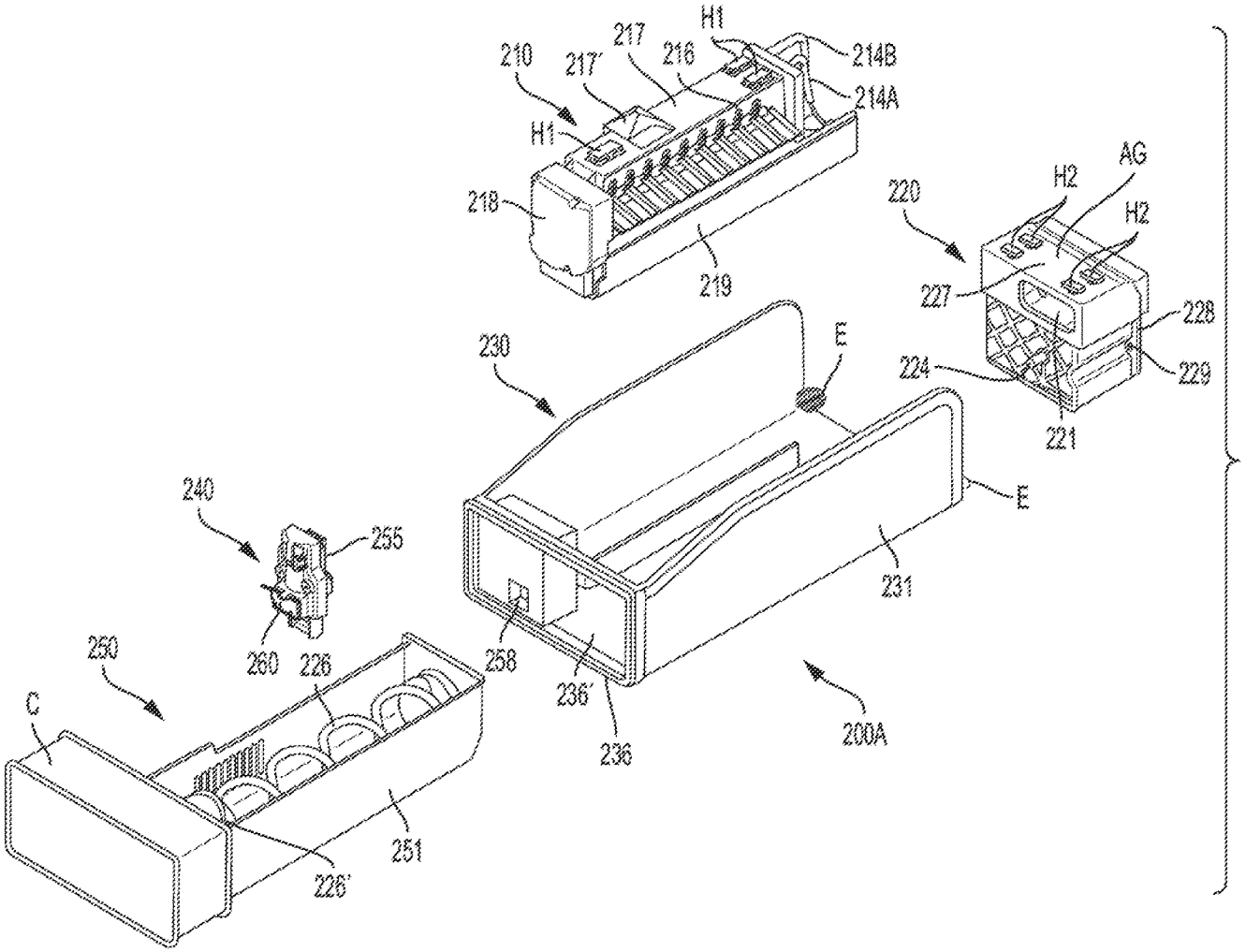
FIG. 2 is an exploded perspective view of the complete ice maker/ice bucket/ice compartment assembly according to an exemplary embodiment consistent with present disclosure.
Figure 3A:
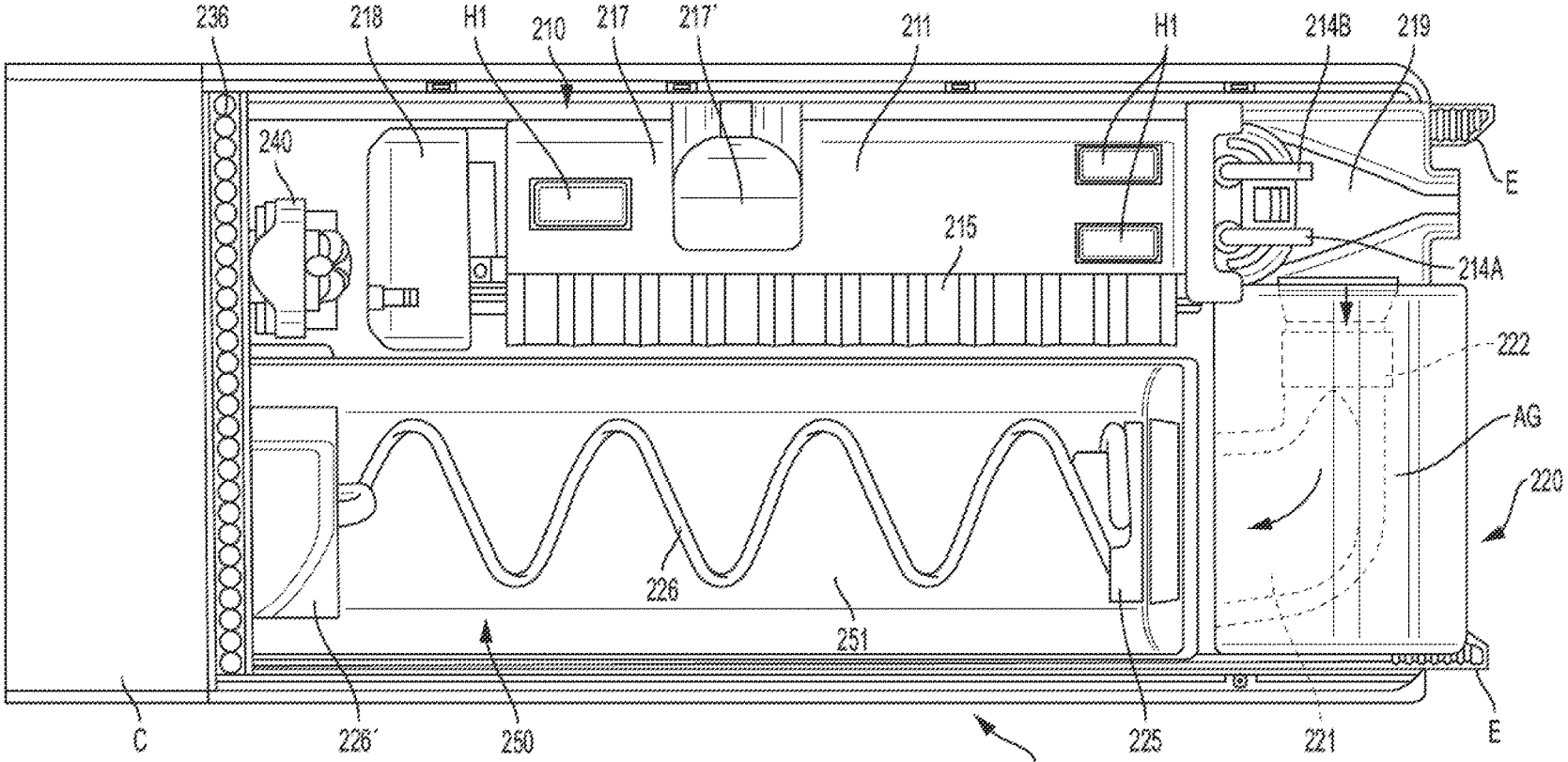
FIG. 3A is a top view of the complete ice maker/ice bucket/ice compartment assembly according to an exemplary embodiment consistent with present disclosure.

FIG. 2 is an exploded perspective view of the complete ice maker/ice bucket/ice compartment assembly 200A (hereinafter referred to as "the complete ice maker compartment assembly 200A") according to an exemplary embodiment consistent with present disclosure. More specifically, the complete ice maker compartment assembly 200A includes an ice maker assembly 210, an air handler/auger motor assembly 220, an ice compartment housing assembly 230, a cube/crush DC motor and reed switch assembly 240, and the ice bucket assembly 250. FIG. 3A is a top view of the complete ice maker compartment assembly 200A according to an exemplary embodiment consistent with present disclosure. Aspects of each of the individual assemblies 210-250 will be discussed in more detail below in connection with the remaining drawings.

Figure 3B:
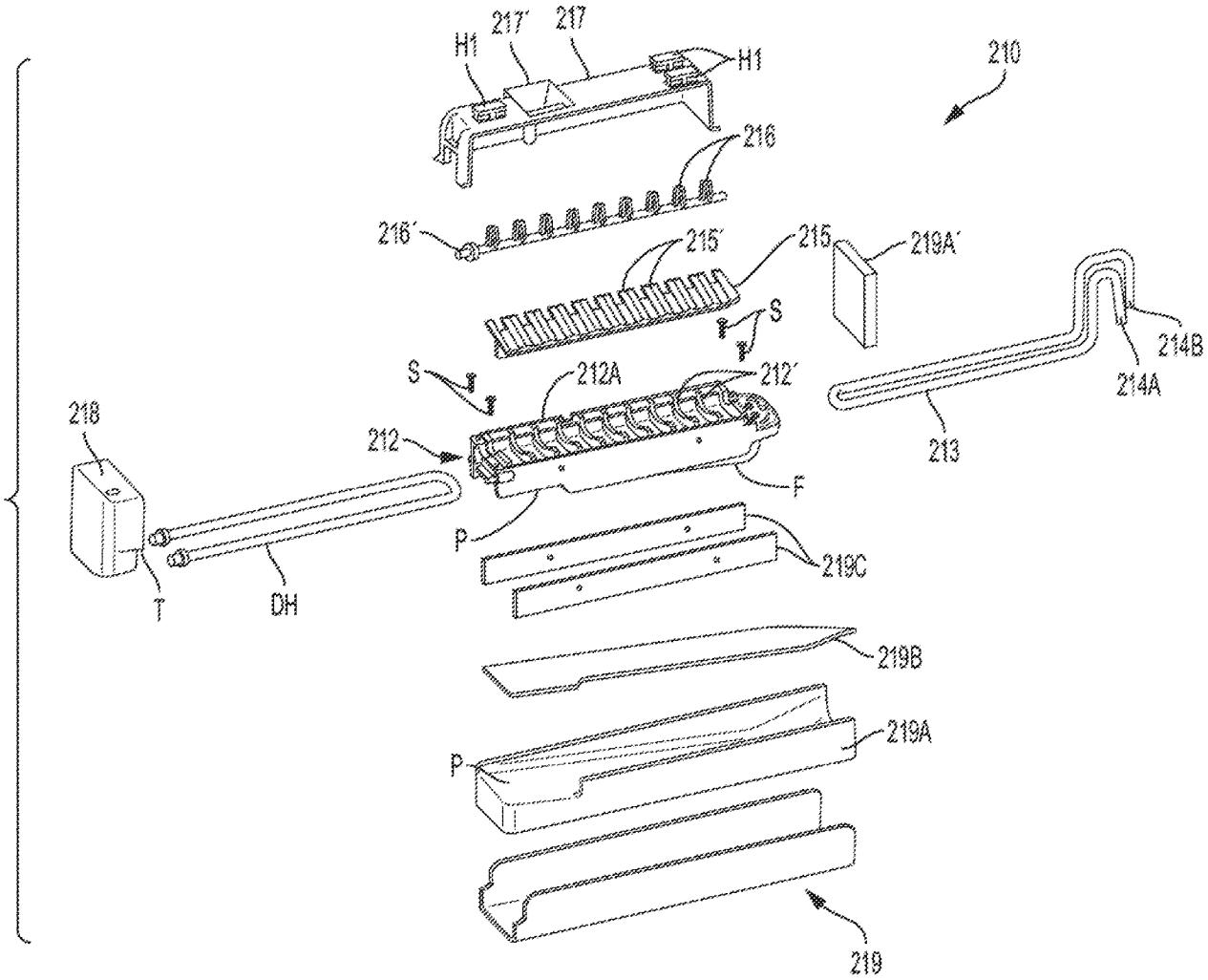
FIG. 3B is an exploded perspective view of the ice maker assembly according to an exemplary embodiment consistent with present disclosure.

As shown in FIGS. 2, 3A, and 3B, the ice maker assembly 210 (which includes an ice maker 211) and the ice bucket assembly 250 (which includes an ice bucket 251) are arranged side-by-side or next to each other in a horizontal direction within the ice compartment housing assembly 230. In other words, no portion of the ice bucket 251 is located below the ice maker 211 when the ice maker 211 is projected downward in a vertical height direction.

With reference to the exploded view of FIG. 3B and FIGS. 6, and 7A-7C, the ice maker assembly 210 includes an ice maker tray/evaporator 212 having an evaporator cooling tube 213 (formed of at least one of copper or a copper alloy, for example) which is, for example, die cast over-molded inside an ice maker tray portion 212A (formed of at least one of aluminum, an aluminum alloy, or other die cast alloys, for example), such that the evaporator cooling tube 213 is embedded in and thus in direct contact with the ice maker tray portion 212A so as to form the ice maker tray/evaporator 212 as a one piece unit. Preferably, but not necessarily, the evaporator cooling tube 213 is formed of copper and the ice maker tray portion 212A is formed of aluminum. Alternatively, the ice maker tray/evaporator 212 is made in two halves. The evaporator cooling tube 213 has an evaporator tube inlet 214A with a capillary connection (i.e., the end is swaged and connected to a capillary tube), and an evaporator cooling tube outlet (suction tube) 214B.

As shown in FIG. 13, the evaporator cooling tube 213 (see FIG. 3B) is connected in a refrigerant circuit 500. The refrigerant circuit 500 includes the ice maker tray/evaporator 212 connected by the evaporator cooling tube outlet (suction tube) 214B in series with a freezer compartment evaporator 504 which is in turn connected to an accumulator 505, a compressor 506, a condenser 507, and a drier 508, and then connects to the evaporator tube inlet 214A having the capillary connection. The refrigerant circuit 500 also includes a bypass line 509 with capillary tube 510 and a refrigerant valve 511 which is located prior to the evaporator tube inlet 214A with the capillary connection in order to bypass the ice maker tray/evaporator 212 and communicate the refrigerant to the freezer compartment evaporator 504. The evaporator tube inlet 214A and the evaporator cooling tube outlet 214B are joined to the foamed-in refrigerator cabinet tubes (which are disposed in the insulated space at the rear of the refrigerator 100) by brazing or by a lock ring. The fresh food compartment 103 can use cold air selectively ducted by a damper 512 in a cold air supply 513 from the freezer compartment 101 and returned in a warm air return 514 (see FIG. 13), or can be part of a separate, independent refrigerant circuit having its own compressor, condenser, drier, capillary tube, and evaporator.

With reference to FIGS. 2, 3A, 3B, 6, 7C, and 9, the ice maker tray portion 212A of the ice maker tray/evaporator 212 includes a mold with a plurality of cavities 212' for receiving water for making ice pieces (see FIGS. 3B and 9). The ice maker tray/evaporator 212 includes molded evaporator fins F (see FIG. 7C) extending vertically downward from the bottom thereof and into an airflow passage P under the ice maker tray/evaporator 212. The evaporator fins F preferably extend down very close to the bottom surface of a form-fitted metal 219D which forms a defrost tray to avoid ice building up on the defrost tray at 219D (see FIG. 7C). Also, freezing the water in the plurality of cavities 212' from bottom to top is desirable as most of the salts dissolved as precipitates as the water temperature is brought down will be away from the ice tray surfaces thereby reducing accumulation (scale buildup) on the bottom of the ice tray, which in turn can cause problems of ejecting the ice pieces as the refrigerator appliance ages and/or if used in hard water regions.

As best shown in FIGS. 3A, 3B, 4A, 6, 7B, and 7C, an ice maker guard 215 is fastened to the side of the ice maker tray/evaporator 212 facing the ice bucket 251. The ice maker guard 215 includes a plurality of projections or fingers 215'. Ejector fingers 216 are arranged on a rotatable shaft 216' and are movable in spaces between the projections 215'. An ice maker bracket 217 is disposed above the mold with a plurality of cavities 212' and includes a water fill cup 217' for directing water into the cavities 212'. The ice maker bracket 217 is attached via fasteners (for example, four screws S) to the ice maker tray/evaporator 212. The ice maker bracket 217 also includes a plurality (for example three) of mounting hooks H1 on a top surface thereof for engaging corresponding mounting members M1 formed in a foamed-in bracket B which is part of the refrigerator structure (see FIGS. 8A, 8B, and 8C). The mounting hooks H1 allow the ice maker assembly 210 to be easily assembled to an inner top wall or liner 103' of the fresh food compartment 103 via the foamed-in bracket B as shown in FIGS. 8A-8C. FIG. 7B shows a wire harness WH for connecting the ice maker assembly 210 to the refrigerator 100. The wire harness WH may be connected to corresponding connectors (not shown) in, for example, the inner top wall 103' of the fresh food compartment 103 at a location within the ice compartment 200.

As shown in FIG. 3B, a defrost heater DH in the form of a loop is disposed under the ice maker tray/evaporator 212 and is operative to heat the ice maker tray/evaporator 212 during a harvest mode to release the pieces of ice for harvesting the pieces of ice and also serves to prevent any ice or frost buildup on the ice maker tray/evaporator 212 including underneath the same including on the evaporator fins F and on form-fitted metal 219D of the defrost tray (see FIG. 7C). The defrost heater DH can be easily replaced when service is required.

As best shown in FIGS. 2, 3A, 3B, 6, and 8A, a gear box 218 is positioned at a front end portion (facing the front of the refrigerator) of the ice maker tray/evaporator 212 and includes gears and a motor (see cutaway of gear box 218 in FIG. 9) for driving the rotatable shaft 216' and the bail arm or optical sensor system (not shown) that senses the amount of ice pieces in the ice bucket 251. A temperature or tray sensor such as a thermistor T is disposed on an outer portion of the gear box 218 facing the ice maker tray/evaporator 212 (see FIG. 3B). Alternatively, the thermistor T can be disposed directly on the ice maker tray/evaporator 212 (see FIG. 13). In this regard, there is no air temperature control inside the slimline ice compartment 200, rather the ice maker tray/evaporator 212 and an electric motor driven fan 222 (discussed in more detail below) within the ice compartment 200 are controlled using the thermistor T which directly monitors the ice/ice maker tray/evaporator 212 temperatures to cycle the motor driven fan 222 and bi-stable refrigerant valve 511 "ON" and "OFF" in order to keep the temperature inside the ice compartment 200 within established limits. Moreover, instead of just the one thermistor T, an additional temperature sensor (not shown) may be disposed inside the gear box 218 and sense the temperature of the plastic housing of the gear box 218. Still further, the additional temperature sensor (not shown) may be built into a body of the electric motor driven fan 222.

As best shown in FIGS. 2, 3B, 6, 7A-7C, and 8A, a drain assembly 219 having insulation 219A and 219A' (formed from, for example, expanded polypropylene (EPP)), a metal (for example, aluminum) drain plate 219B, and a collar 219C is positioned under and attached with the ice maker tray/evaporator 212. While the metal drain plate 219B is shown in FIG. 3B as a flat metal plate, it can also be form-fitted to the insulation 219A to form the defrost tray as shown at 219D in FIG. 7C. The drain assembly 219 is configured with an angle toward the rear so as to drain any water from a defrost mode of the ice maker assembly 210 away from a rear end portion (see FIGS. 6 and 7C) of the ice maker assembly 210 and communicates with tubing (not shown) which in turn communicates with an evaporation tray (not shown) in a machine room of the refrigerator 100. The drain assembly 219 also cooperates with the bottom of the ice maker tray/evaporator 212 to form the airflow passage P under the ice maker tray/evaporator 212 and through the evaporator fins F.

With reference to FIGS. 2, 3A, 4A, and 9-12B, the air handler/auger motor assembly 220 is disposed at the rear portion of the slimline ice compartment 200. The air handler/auger motor assembly 220 includes an air guide AG with an air passage or air duct 221 having the electric motor driven fan 222 disposed therein. Although the electric motor driven fan 222 is shown with a vertical orientation, the electric motor driven fan 222 can also be oriented horizontally in a vertical portion of the air passage 221. The air passage 221 is located at an upper portion of the air handler/auger motor assembly 220. The air passage 221 communicates with a rear end portion P2 (see FIGS. 6, 7B, and 9) of the airflow passage P under the ice maker tray/evaporator 212. An inlet of the electric motor driven fan 222 communicates with the airflow passage P under the ice maker tray/evaporator 212 and through the evaporator fins F such that the electric motor driven fan 222 creates a suction and draws cool air from the ice maker tray/evaporator 212 and discharges the cool air through the air passage 221 (see especially FIG. 11) and either over or around the ice bucket 251 to prevent the ice pieces from melting (see especially FIGS. 12A and 12B). The cool or cold air that circulates inside the ice compartment 200 is only required to keep the ice compartment 200 cold enough to prevent ice stored in the ice bucket 251 from melting which is normally below −3° C. and preferably, but not necessarily, around −5° C. The air passage 221 makes a substantially 90 degree turn and widens prior to opening above the ice bucket 251 (see FIGS. 3A, 11 and 12B). An auger motor 223 is located at a lower portion of the air handler/auger motor assembly 220. The auger motor 223 includes a motor shaft 224 and drive bar 224' (see FIG. 10) that is connected via a coupler 225 to an auger member 226 such as a coiled auger wire or tube or the like. The other end of the auger member 226 is connected to an auger drum 226' which guides the ice pieces to the crushing blades and the opening in the front cover which are discussed later.

The air handler/auger motor assembly 220 includes a plurality (for example four) of mounting hooks H2 on the top surface 227 (see FIG. 2) for engaging corresponding mounting members M2 (shown schematically in FIGS. 8A and 8B) formed in the foamed-in bracket B which is part of the refrigerator structure for mounting the air handler/auger motor assembly 220 to the fresh food compartment 103. The air handler/auger motor assembly 220 may also include one or more vertical mounting plates 228 with fastener holes 229 (see FIG. 2) for further mounting the air handler/auger motor assembly 220 to an inner back wall or liner 103" of the fresh food compartment 103 via fasteners such as screws (not shown).

Figure 4B:
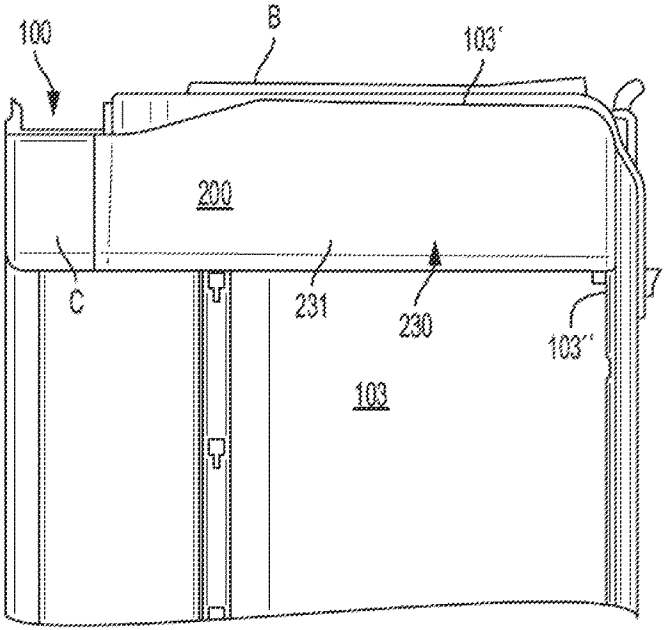
FIG. 4B is a fragmentary side elevational view showing the exterior of the ice compartment inside the refrigerator compartment according to an exemplary embodiment consistent with present disclosure.
Figure 5:
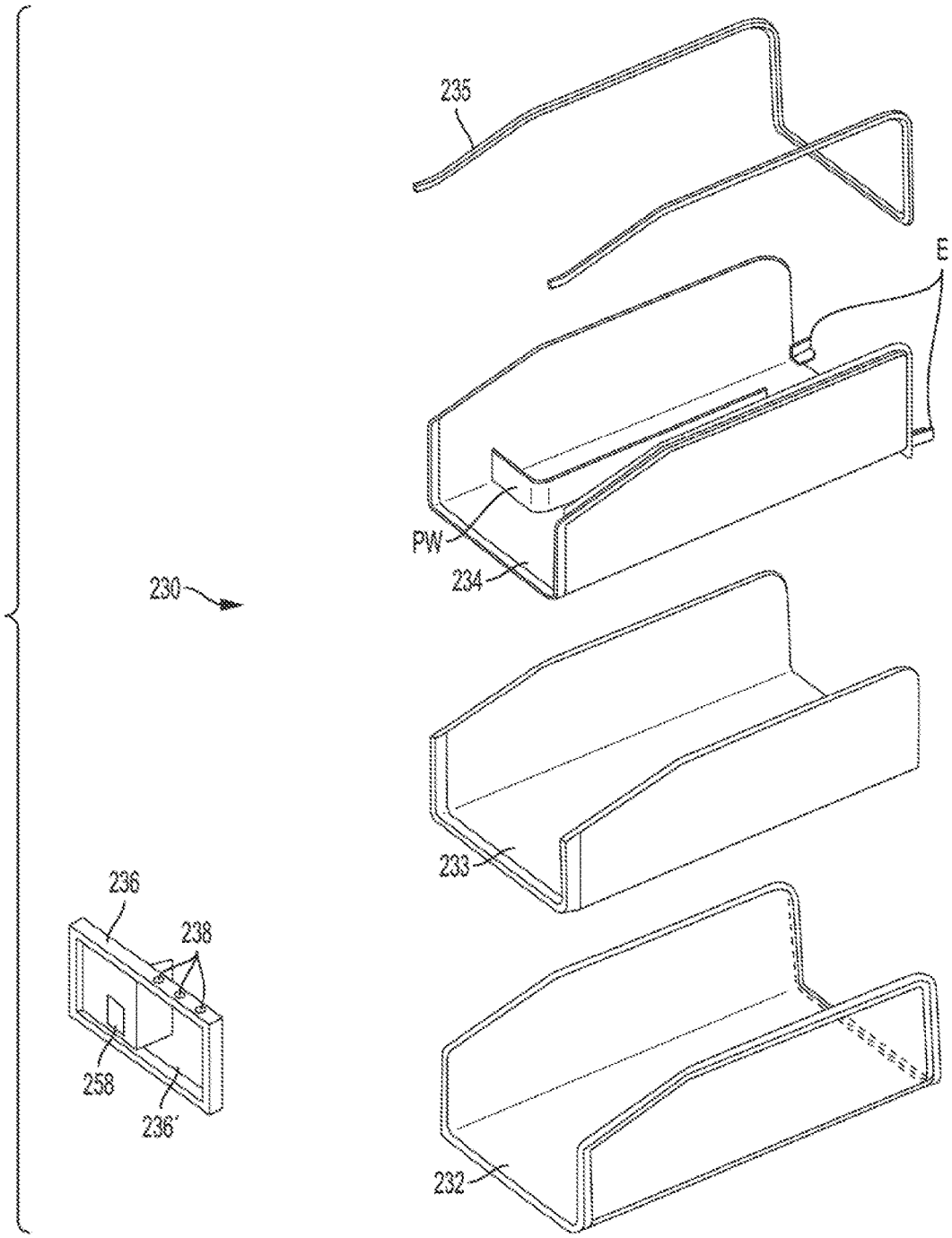
FIG. 5 is an exploded perspective view of a U-shaped ice compartment assembly according to an exemplary embodiment consistent with present disclosure.
Figure 6:
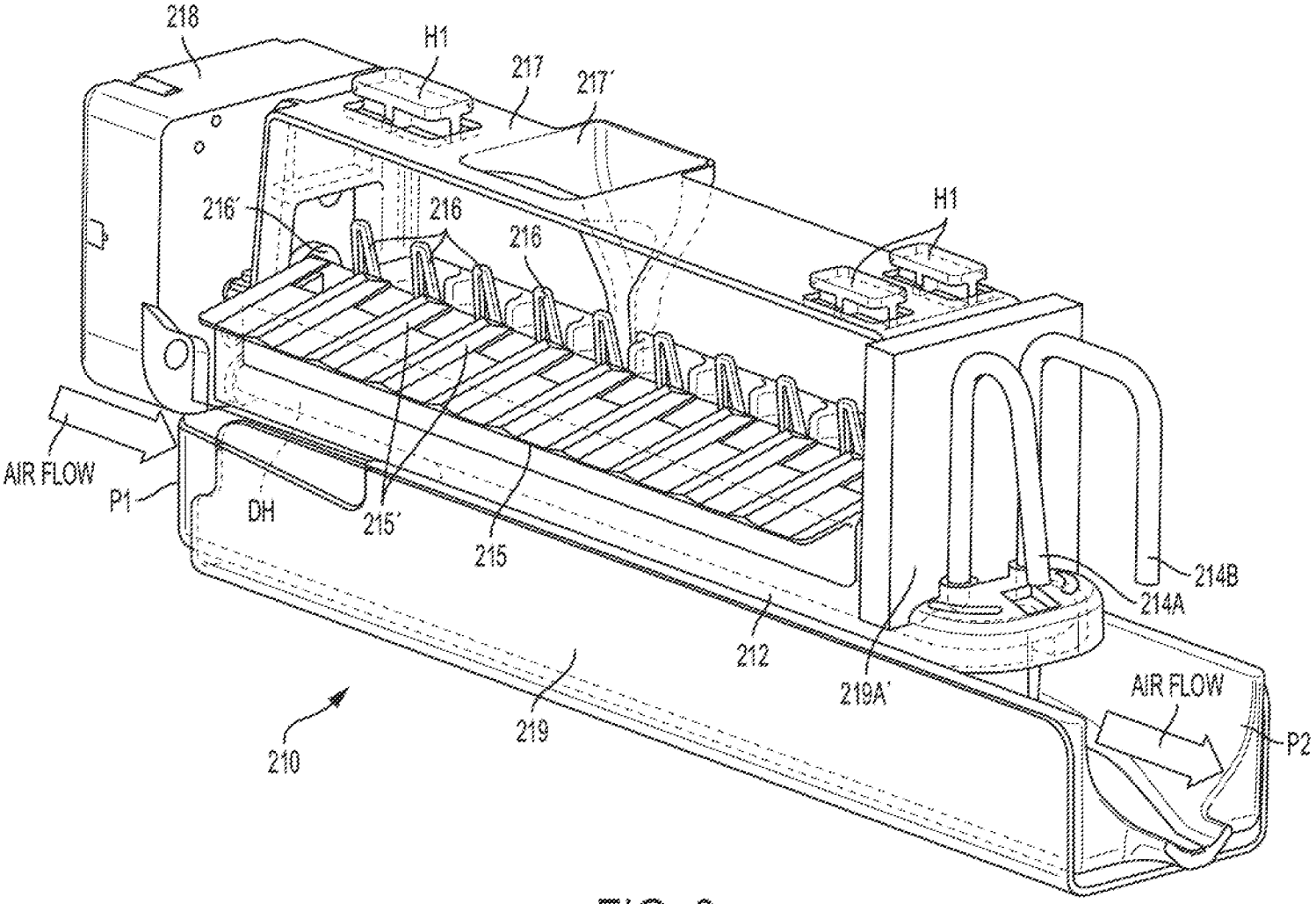
FIG. 6 is a perspective view of the ice maker assembly according to an exemplary embodiment consistent with present disclosure.

As best shown in FIGS. 2, 4B, and 5, one embodiment of the ice compartment housing assembly 230 is formed by a U-shaped, insulated housing 231 that cooperates with the inner top wall 103' and the inner back wall 103" of the fresh food compartment 103. As best shown in FIG. 4B, the U-shaped, insulated housing 231 is contoured to fit the shape of the inner top wall 103' and an inner back wall 103" of the fresh food compartment 103. The U-shaped, insulated housing 231 includes a U-shaped outer wall 232, a U-shaped insulation 233 (formed of, for example, expanded polypropylene (EPP), expanded polystyrene (EPS), vacuum insolated panel (VIP)), a U-shaped inner wall 234, a gasket 235 that is disposed between an edge of the U-shaped, insulated housing 231 and the inner top wall 103' and the inner back wall 103" of the fresh food compartment 103, and a housing collar 236 that is disposed on an open front portion of the U-shaped, insulated housing 231, the housing collar 236 having an opening 236' therein for receiving the ice bucket 251. The gasket 235 may be an extruded gasket formed from, for example, polyvinyl chloride (PVC) that is rubberized, and that is inserted into a groove that is formed along the edge of the U-shaped, insulated housing 231. The U-shaped, insulated housing 231 includes an inner L-shaped positioning wall PW (see FIG. 5) for positioning the U-shaped, insulated housing into position over the ice maker assembly 210. The U-shaped, insulated housing 231 also includes locating extensions E (for example, two extensions E) extending from a lower rear portion of the edge, the locating extensions E being configured to fit into a bracket (not shown) positioned in the inner back wall 103" of the fresh food compartment 103. Moreover, the housing collar 236 having the opening 236' therein for receiving the ice bucket 251 further includes a plurality of fastener holes 238 configured to receive fasteners (for example, three screws, not shown) for fastening the U-shaped, insulated housing 231 to the inner top wall 103' of the fresh food compartment 103. With such a construction, the U-shaped, insulated housing 231 is slid into position in the upper left hand corner of the fresh food compartment 103 and over the ice maker assembly 210 and then held in place by the locating extensions E at the lower rear portion and the fasteners in the holes. The insulated housing 231 is not limited to a U-shape and can also be other shapes such as, for example, L-shaped.

With reference to FIGS. 2, 3A, 4A, 9, and 12A, the cube/crush DC motor and reed switch assembly 240 is disposed within the ice compartment housing assembly 230 at a location in front of the ice maker assembly 210 and is mounted, for example, to a back wall of the housing collar 236 or similar. The cube/crush DC motor and reed switch assembly 240 is used to control whether cubed or crushed ice is delivered to the user. More specifically, the ice bucket or bin 251 has an ice bucket outlet opening 252 (seen in the cutaway view of FIG. 12A) in a front cover C through which ice pieces are delivered, as will be described in more detail below. As shown in FIG. 9, the ice bucket outlet opening 252 has an ice gate 253 that pivots, such that the ice gate 253 opens or closes. When the ice gate 253 is closed, it forces the ice pieces, such as in the shape of cubes, towards a plurality of crushing blades 254 (for example, when "crushed" ice is selected by the user). On the other hand, when "cubed" ice is selected by the user, the ice gate 253 opens thus allowing the ice cubes to come out through the ice bucket outlet opening 252 missing the crushing blades. The default position for the ice gate 253 is closed, and this minimizes any ice cubes from falling out through the ice bucket opening 252 when the user pulls out the ice bucket 251. This also prevents the user from touching the blades while pulling out the ice bucket 251. The pivoting of the ice gate 253 is carried out by a rod 253' (see the cutaway/phantom view of FIG. 9) that engages into an actuator head that is controlled by a cube/crush DC reversible motor 255 (for example, a 12 volt DC reversible electric motor as shown in FIGS. 2 and 9) that moves up (closing the ice gate 253) and down (opening the ice gate 253). The rod 253' passes through an opening 258' in the housing collar 236 (see FIG. 2). The ice bucket assembly 250 has a magnet 258 disposed on a gate cover 259 of the front cover C of the ice bucket assembly 250 and that interfaces with a reed switch 260 that is assembled on a motor bracket 255' of the cube/crush DC reversible motor 255 (see FIGS. 2 and 9). Accordingly, when the ice bucket 251 with front cover C is removed from the opening 236' in the housing collar 236 of the ice compartment 200, the reed switch 260 opens the circuit thereby disabling: any ice dispensing, the ice maker 211, and the electric motor driven fan 222. This in turn prevents any ice harvesting while the ice bucket 251 is not present, and also minimizes moisture ingress inside the ice compartment 200. Once the ice bucket 251 is placed back into the ice compartment housing assembly 230, the normal operation is resumed.

Figure 4A:
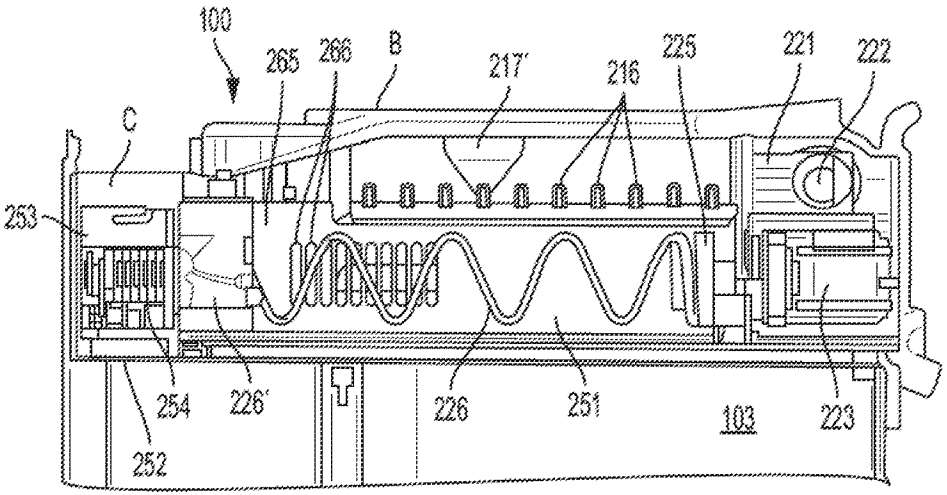
FIG. 4A is a fragmentary cutaway side elevational view showing the complete ice maker/ice bucket/ice compartment assembly according to an exemplary embodiment consistent with present disclosure.

With reference to FIGS. 2, 3, 4A, 9, and 12A, the ice bucket assembly 250 includes the ice bucket or bin 251 for storing ice pieces and in which the auger member 226 is disposed, and the front cover C. As noted above, the ice bucket 251 is removably mounted in the slimline ice compartment 200. As shown in FIG. 4A, in one embodiment, an inner side wall 265 of the ice bucket 251 is formed with a plurality of through-holes or slots 266 which allow the air that has cooled the ice to exit the ice bucket 251 and enter at a front end portion P1 of the airflow passage P under the ice maker tray/evaporator 212 to be cooled again (see FIGS. 7A and 7B). Alternatively, instead of having the air exit through the slots 266 on the inner side wall 265 of the ice bucket 251, the air can go around and under (not shown) the ice bucket 251 after exiting the air passage 221. As noted above, the front cover C has the ice bucket outlet opening 252 (see FIG. 12A) on the bottom through which ice pieces are delivered when a user dispenses ice pieces. The ice bucket outlet opening 252 cooperates with the ice chute extension 108 to deliver ice pieces to the dispenser when the door 104 is in a closed position. The interface between the ice bucket outlet opening 252 and the top of the ice chute extension 108 can be sealed with a gasket, have a partial or open gasket, or have no gasket at all. In the latter two cases, some air is permitted to move between the fresh food compartment 103 and the ice compartment 200 by moving into the region inside the ice chute extension 108 and through the ice bucket outlet opening 252 and into the ice compartment 200 and vice versa.

FIG. 9 shows that the bottom of the front cover C also includes a gripper recess G for the user to insert their fingers to pull and remove the ice bucket 251 or return the same into position. The hollow inside of the front cover C includes insulation I, and the insulation may entirely fill the inside of the front cover C. Alternatively, the lower region around the ice bucket outlet opening 252 may be free of any insulation I (see FIG. 12A).

In operation and during the ice making mode, the refrigerant valve 511 (see FIG. 13) directs the refrigerant gas through the evaporator tube 213 which directly contacts the ice tray by virtue of being die cast over-molded inside the ice maker tray/evaporator 212. A water fill valve (not shown) that is located in the water fill tube that connects to the connection WF (see FIG. 8B) is opened in order to fill the cavities 212' with water and then is closed after a predetermined period of time (e.g., 5 seconds) has elapsed. Once the water in the individual cavities 212' is frozen, which is determined by the thermistor T that continuously senses the ice maker tray/evaporator 212 up to a predefined temperature, the refrigerant valve 511 bypasses or diverts the refrigerant gas to, for example, the freezer evaporator 504 and then the defrost heater DH is turned "ON". Once a predetermined temperature is reached, the defrost heater DH is turned "OFF" and the ejector fingers 216 are rotated by the shaft 216' to scoop out the ice pieces (for example, ice cubes) from the tray cavities 212'. After a complete turn of 360 degrees of the ejector fingers, the cycle is restarted with water by the water fill valve (see connection WF for a water fill tube in FIG. 8B) filling the cavities 212' and the refrigerant valve 511 redirecting the refrigerant to the ice maker tray/evaporator 212.

The present invention has substantial opportunity for variation without departing from the spirit or scope of the present invention. For example, while FIG. 1 shows a French door-bottom mount (FDBM) style refrigerator, the present invention can be utilized in FDBM configurations having one or more intermediate compartments (such as, but not limited to, pullout drawers) that can be operated as either fresh food compartments or freezer compartments and which are located between the main fresh food compartment and the main freezer compartment, a side-by-side refrigerator where the refrigerator compartment and the freezer compartment are disposed side-by-side in a vertical orientation, as well as in other well-known refrigerator configurations, such as but not limited to, top freezer configurations, bottom freezer configurations, and the like. Also, while the slimline ice compartment is shown in the fresh food compartment, the slimline ice compartment could be disposed in a freezer compartment.

Those skilled in the art will recognize improvements and modifications to the exemplary embodiments of the present invention. All such improvements and modifications are considered within the scope of the concepts disclosed herein and the claims that follow.

What is claimed is:

1. A refrigerator comprising:
- a refrigerator compartment;
- a freezer compartment;
- an ice compartment disposed in the refrigerator compartment;
- an ice maker assembly disposed in the ice compartment, the ice maker assembly including an ice maker tray/evaporator having an evaporator cooling tube which is in direct contact with an ice maker tray portion;
- an ice bucket for storing ice, the ice bucket being disposed in the ice compartment; and
- an air handler/auger motor assembly disposed at a rear portion of the ice compartment behind the ice bucket;
- wherein the air handler/auger motor assembly comprises an air duct having a motor driven fan disposed therein, wherein an inlet of the motor driven fan communicates directly with an airflow passage under the ice maker tray/evaporator, such that the motor driven fan creates a suction and draws cool air from the ice maker tray/evaporator and discharges the cool air through the air duct and to the ice bucket to prevent any ice pieces in the ice bucket from melting.

2. The refrigerator of claim 1, wherein the ice maker assembly and the ice bucket are arranged side-by-side in a horizontal direction within the ice compartment.

3. The refrigerator of claim 2, wherein no portion of the ice bucket is located below the ice maker assembly when the ice maker assembly is projected downward in a vertical height direction.

4. The refrigerator of claim 1, wherein the ice compartment is disposed in an upper corner of the refrigerator compartment.

5. The refrigerator of claim 1, wherein the refrigerator is a French door-bottom mount configuration having the refrigerator compartment on top and the freezer compartment below the refrigerator compartment.

6. The refrigerator of claim 5, wherein the ice compartment is disposed in an upper left hand corner of the refrigerator compartment.

7. The refrigerator of claim 1, wherein the ice bucket is removably mounted in the ice compartment.

8. The refrigerator of claim 1, wherein the ice compartment has a thin dimension in a vertical height direction H of approximately 5.6 inches±2.0 inches, and wherein the ice compartment has a horizontal width W of approximately 10.4 inches±2.0 inches.

9. The refrigerator of claim 6, wherein the ice bucket has a front cover, and the front cover has an opening in a bottom portion for discharging pieces of ice.

10. The refrigerator of claim 9, wherein the refrigerator compartment includes a door, and further comprising an ice chute for an ice dispenser and being disposed in the door, the ice chute being configured to communicate with the opening in the front cover via an ice chute extension.

11. The refrigerator of claim 1, wherein a bottom portion of the ice maker tray/evaporator includes evaporator fins which extend downward substantially vertically.

12. The refrigerator of claim 1, wherein the air duct is located at an upper portion of the air handler/auger motor assembly.

13. The refrigerator of claim 1, wherein the air duct makes a substantially 90 degree turn and widens prior to opening above the ice bucket.

14. A refrigerator comprising:
- a fresh food compartment;
- a freezer compartment;
- an ice compartment disposed in the fresh food compartment;
- an ice maker assembly disposed in the ice compartment, the ice maker assembly including an ice maker tray/evaporator having an evaporator cooling tube which is in direct contact with an ice maker tray portion;
- an ice bucket for storing ice, the ice bucket being disposed in the ice compartment; and
- an air guide disposed at a rear portion of the ice compartment adjacent to the ice bucket;
- wherein the air guide comprises an air duct having a fan disposed therein, wherein an inlet of the fan communicates directly with an airflow passage under the ice maker tray/evaporator, such that the fan creates a suction in the airflow passage under the ice maker tray/evaporator and discharges the cool air through the air duct of the air guide and to the ice bucket.

15. The refrigerator of claim 14, wherein the air guide is disposed above a rear portion of the ice bucket.

16. The refrigerator of claim 15, wherein the air duct of the air guide makes a substantially 90 degree turn and widens prior to opening above the ice bucket.

17. The refrigerator of claim 14, wherein the air guide comprises a plurality of mounting hooks on a top surface thereof.

18. The refrigerator of claim 14, wherein the ice bucket comprises an inner side wall formed with a plurality of through-holes which allow air that has cooled the ice to exit the ice bucket and enter at a front end portion of the airflow passage under the ice maker tray/evaporator.

19. The refrigerator of claim 18, wherein a bottom portion of the ice maker tray/evaporator includes evaporator fins which extend downward substantially vertically into the airflow passage under the ice maker tray/evaporator.

20. A refrigerator comprising:
- a refrigerator compartment;
- a freezer compartment;
- an ice compartment disposed in the refrigerator compartment;

an ice maker assembly disposed in the ice compartment, the ice maker assembly including an ice maker tray/evaporator having an evaporator cooling tube which is in direct contact with an ice maker tray portion;

an ice bucket for storing ice, the ice bucket being disposed in the ice compartment; and an air handler/auger motor assembly disposed at a rear portion of the ice compartment behind the ice bucket;

wherein the air handler/auger motor assembly comprises an air passage having a motor driven fan disposed therein, wherein an inlet of the motor driven fan communicates with an airflow passage under the ice maker tray/evaporator, such that the motor driven fan creates a suction and draws cool air from the ice maker tray/evaporator and discharges the cool air through the air passage and to the ice bucket to prevent any ice pieces in the ice bucket from melting, wherein the ice maker assembly and the ice bucket are arranged side-by-side in a horizontal direction within the ice compartment, and wherein no portion of the ice bucket is located below the ice maker assembly when the ice maker assembly is projected downward in a vertical height direction.

* * * * *